US007558505B2

(12) United States Patent
Yang

(10) Patent No.: US 7,558,505 B2
(45) Date of Patent: Jul. 7, 2009

(54) IMAGE FORMING APPARATUS AND METHOD OF SENSING PRINTING MEDIUM JAM THEREIN

(75) Inventor: Jung-min Yang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 454 days.

(21) Appl. No.: 11/493,676

(22) Filed: Jul. 27, 2006

(65) Prior Publication Data

US 2007/0036587 A1 Feb. 15, 2007

(30) Foreign Application Priority Data

Aug. 11, 2005 (KR) ..... 10-2005-0073819

(51) Int. Cl.
*G03G 15/20* (2006.01)
*G03G 15/00* (2006.01)

(52) U.S. Cl. ..... 399/124; 399/22

(58) Field of Classification Search ..... 399/21, 399/22, 107, 124
See application file for complete search history.

(56) References Cited

U.S. PATENT DOCUMENTS 5,010,363 A * 4/1991 Higashio et al. ..... 399/21
5,335,043 A * 8/1994 Kluger et al. ..... 399/21
5,383,654 A * 1/1995 Iseda
5,971,388 A * 10/1999 Hattori et al.

FOREIGN PATENT DOCUMENTS

| | | | |
|---|---|---|---|
| JP | 05019547 | A * | 1/1993 |
| JP | 10063163 | A * | 3/1998 |
| JP | 10157225 | A * | 6/1998 |
| JP | 11-327329 | | 11/1999 |
| JP | 11322128 | A * | 11/1999 |
| JP | 2003-057892 | | 2/2003 |
| JP | 2004-252080 | | 9/2004 |
| JP | 2005-60058 | | 3/2005 |
| KR | 2001-0058639 | | 7/2001 |

OTHER PUBLICATIONS

Korean Office Action dated Jun. 26, 2006 issued in KR 2005-73819.

* cited by examiner

*Primary Examiner*—Susan S Lee
(74) *Attorney, Agent, or Firm*—Stanzione & Kim LLP

(57) ABSTRACT

An image forming apparatus and a method of sensing a printing medium jam in the image forming apparatus. The image forming apparatus includes a developing unit, a transfer unit, a fixing unit, a feed-out unit, a lower cover to come in contact with a printing medium when the printing medium is jammed on a feed path and which opens upwards when a pressure of the printing medium caused by the printing medium jam is greater than a predetermined reference value, an upper cover to be opened by the contact of the lower cover when the lower cover opens, and a printing medium jam detection unit operated by the upper cover.

23 Claims, 7 Drawing Sheets

IMAGE FORMING APPARATUS AND METHOD OF SENSING PRINTING MEDIUM JAM THEREIN

CROSS-REFERENCE TO RELATED APPLICATIONS

This application claims priority under 35 U.S.C. §119(a) from Korean Patent Application No. 10-2005-0073819, filed on Aug. 11, 2005, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus that can effectively sense and release a printing medium jam on a feed path, and a method of sensing a printing medium jam in the image forming apparatus.

2. Description of the Related Art

Conventional image forming apparatuses have a charging process that charges a surface of a photoconductor to an electric potential, an exposing process that irradiates light onto the surface of the photoconductor from a light scanning unit, such as a laser scanning unit, and forms an electrostatic latent image on the surface of the photoconductor, a developing process that develops the electrostatic latent image into a visible toner image by supplying toner developing material onto the electrostatic latent image, a paper feeding process that feeds printing paper along a feed path after feeding the printing paper from a paper feeding cassette, a transfer process that transfers the toner image from the photoconductor onto the printing paper, a fusing process that fuses the toner image onto the printing paper by applying a high temperature and pressure, and a feed-out process that feeds the printing paper out of the image forming apparatus.

During the fusing process, the printing paper becomes flexible due to the high temperature and pressure for fusing the toner image. This factor or some other factors can contribute to causing the printing paper to become entangled around a heat roller when the printing paper is fed through a fuser nip, which causes a printing paper jam or "accordion jam".

In order to sense the printing paper jam, an out-feed sensor is usually located between the fuser nip and an out-feed roller. However, the out-feed sensor is expensive and therefore increases a production cost, and when the out-feed sensor malfunctions, the printing paper jam may become serious, possibly making the removal of jammed paper difficult and damaging peripheral elements. Therefore, there is a need to prevent serious printing paper jams and to minimize a production cost generated as a result of attempts to address the printing paper jam.

SUMMARY OF THE INVENTION

The present general inventive concept provides an image forming apparatus having a lower production cost, and a method of sensing a printing medium jam in the image forming apparatus.

The present general inventive concept also provides an image forming apparatus, in which a serious printing medium jam can be prevented so that a guide claw which separates a printing medium passing a fuser nip from a heat roller is prevented from being pressed by the printing medium and damaging the heat roller when the printing medium is jammed, and a method of sensing a printing medium jam in the image forming apparatus.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus to form an image on a printing medium the image forming apparatus including a lower cover disposed to be contacted by the printing medium when the printing medium is jammed on a feed path and which opens upwards when a pressure of the printing medium caused by the printing medium jam is greater than a predetermined reference value, an upper cover disposed to be opened by being contacted by the lower cover when the lower cover opens, and a printing medium jam detection unit to be operated by the upper cover.

The image forming apparatus may further include fixing unit located at a lower side of the lower cover and including a heat roller and a pressure roller to fuse a toner image onto the printing medium by applying heat and pressure to the toner image transferred onto the printing medium.

The image forming apparatus may further include a guide claw to contact the heat roller and separate the printing medium fed out of the fixing unit from the heat roller.

The lower cover may include a first lower cover fixed to a main frame of the image forming apparatus, and a second lower cover to open upwards when the pressure of the printing medium caused by the printing medium jam is greater than the predetermined reference value.

The second lower cover may include at least two portions connected with the first lower cover, at least one portion of the second lower cover is rotatably connected with the first lower cover and at least another portion of the second lower cover is connected with the first lower cover by a hook, and the connection by the hook is released when the pressure of the printing medium caused by the printing medium jam is greater than the predetermined reference value.

The upper cover may include a first upper cover fixed to a main frame of the image forming apparatus, and a second upper cover disposed to be opened by being contacted by the lower cover when the lower cover opens.

The second upper cover may include at least two portions connected with at least two portions of the first upper cover, at least one portion of the second upper cover is rotatably connected with the first upper cover and at least another portion of the second upper cover is connected with the first upper cover by a hook, and the connection by the hook is released by pressure from the lower cover when the lower cover opens.

The printing medium jam detection unit may include a pressure portion formed in the upper cover, a base located in a main frame of the image forming apparatus, a plunger located in the base at a position facing the pressure portion, a spring in contact with the plunger, an operation lever connected to the spring, and a switch located in the main frame at a position facing the operation lever to perform opening and closing operations.

When the upper cover is closed, the pressure portion may push the plunger down, the plunger may then push the spring, the spring may then push the operation lever, and the operation lever may then operate the switch.

When the upper cover is open, the pressure portion may be separated from the plunger, the spring connected to the plunger may be released from the operation lever, and the operation lever may release the switch.

The pressure unit may have an I shape, and the operation lever may have an L shape.

The foregoing and/or other aspects and utilities of the present general inventive concept may also be achieved by providing a method of sensing a printing medium jam on a feed path in an image forming apparatus having a cover and a printing medium jam detection unit, the method including causing the cover to open upwards by the printing medium when a pressure of the printing medium caused by the printing medium jam is greater than a predetermined reference value; and activating the printing medium jam detection unit by opening and closing operations of the cover.

The foregoing and/or other aspects and utilities of the present general inventive concept may also be achieved by providing a detection system useable in an image forming apparatus to detect a printing medium jam, the system including a frame, at least one cover unit to be opened by a pressure applied thereto by a printing medium when the pressure of the printing medium due to a printing medium jam is greater than a predetermined threshold pressure, and a detection unit to detect the printing medium jam when the at least one cover unit is in an open position.

The at least one cover unit may include a lower cover unit to be opened by a pressure applied thereto by the printing medium when the pressure of the printing medium is greater than the predetermined threshold pressure, and an upper cover unit to receive a pressure from the lower cover unit when opened and to be opened by the lower cover unit pressure, and the detection unit may be in contact with the upper cover unit to detect the printing medium jam when the upper cover unit opens. At least one of a weight of the upper cover unit, a weight of the lower cover unit, and a connection of the lower and upper cover units can prevent the upper cover unit from opening until the pressure is greater than the predetermined threshold pressure.

The detecting system may further include a fixing unit to apply heat and pressure to a printing medium to fix an image thereon as the printing medium passes through the fixing unit along a feed path. The detecting unit may be positioned a predetermined distance apart from the feed path. The lower cover unit may cover at least a portion of the fixing unit. The detecting unit may include an elastic member to elastically-bias the upper cover unit to be in a closed position, and signal generating part to generate a signal to stop a printing operation when the upper cover unit is in the open position. The detecting unit may be electrically-connected to the upper cover unit. The detecting unit may generate a first signal to continue a printing operation and a second signal to stop a printing operation based on whether the upper cover unit is in a closed position or in the open position. The pressure received from the lower cover unit by the upper cover unit may break a connection between the lower and upper cover units.

The upper cover unit may include a fixed part fixed to the frame, and a moveable part moveable in response to the pressure received from the lower cover unit. The lower cover unit may include a fixed part fixed to the frame, and a moveable part moveable in response to the pressure applied by the printing medium blockage when the pressure is greater than the predetermined threshold pressure.

The foregoing and/or other aspects and utilities of the present general inventive concept may also be achieved by providing a method of detecting a printing medium blockage a in an image forming apparatus, the method including causing a cover unit to open via a pressure applied thereto from by a printing medium jam when the pressure is greater than a threshold value, and controlling a printing operation based on a detection of a position of the cover unit.

The foregoing and/or other aspects and utilities of the present general inventive concept may also be achieved by providing a method of detecting a printing medium jam a in an image forming apparatus, the method including causing a lower cover unit to open using a pressure applied thereto from by a printing medium when the pressure of the printing medium due to a printing medium jam is greater than a threshold value, causing an upper cover unit to open using a pressure from the lower cover unit when the lower cover unit opens, and detecting the printing medium jam when the upper cover unit opens.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
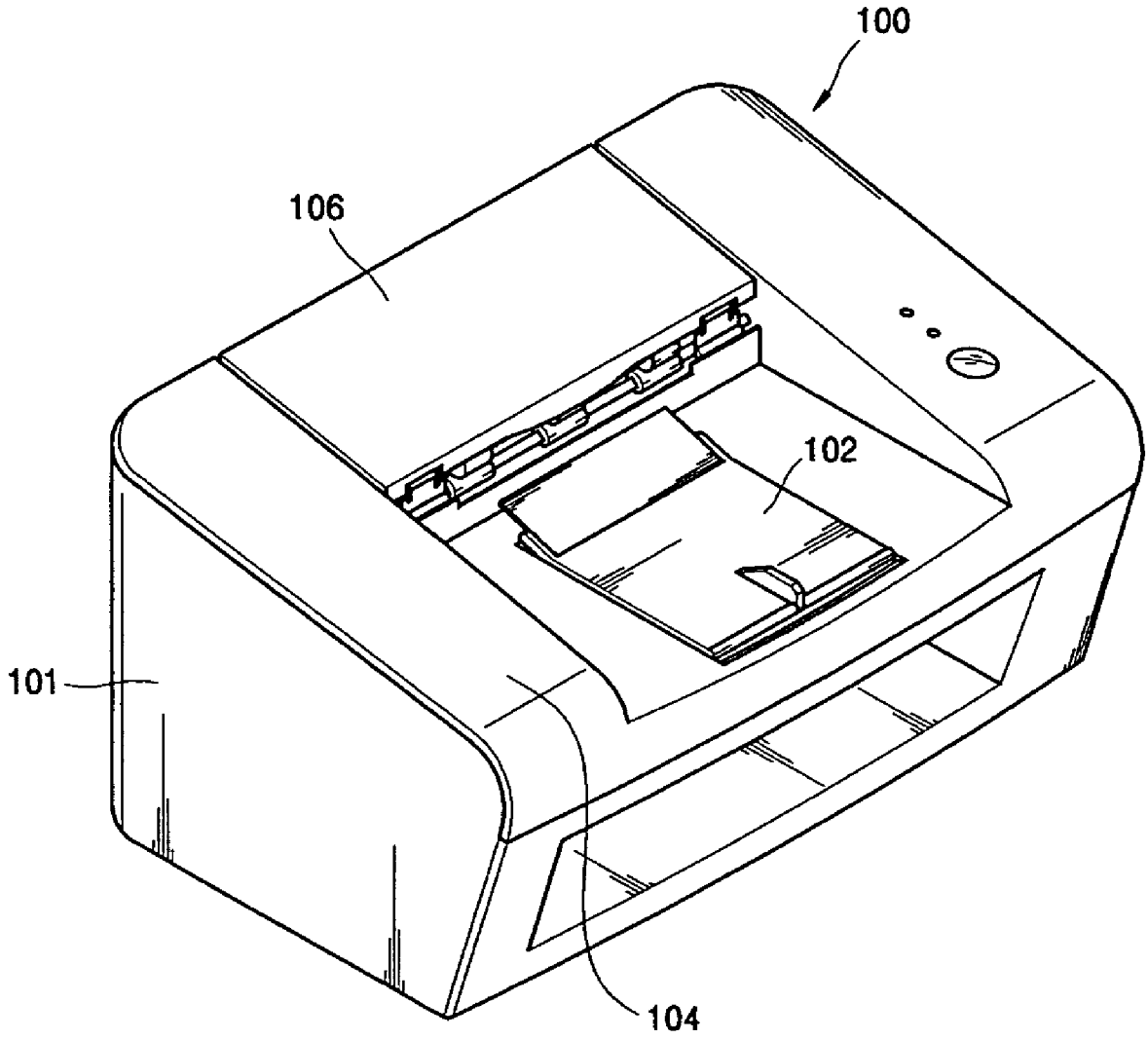
FIG. 1 is a schematic perspective view illustrating an image forming apparatus, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
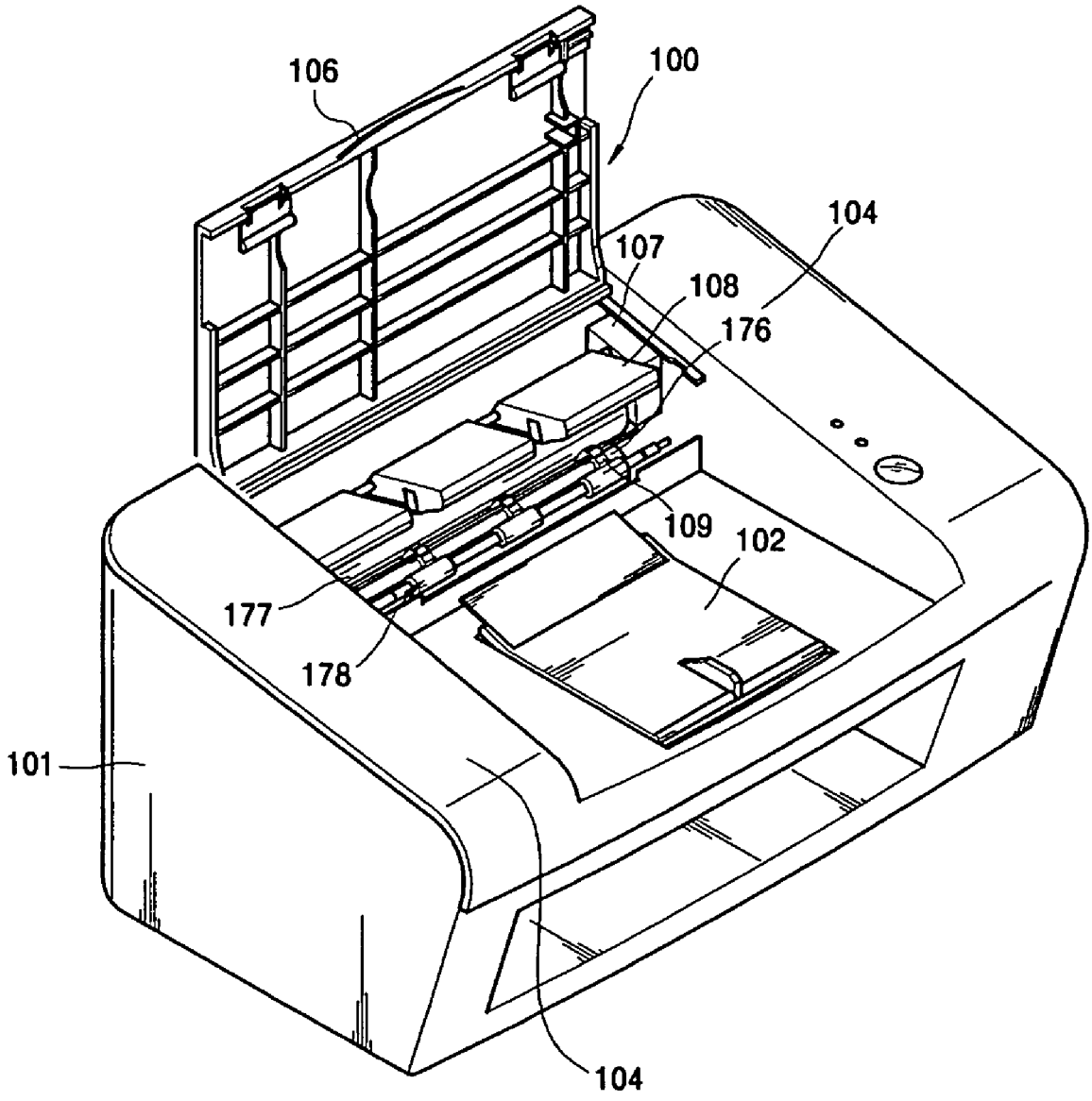
FIG. 2 is a perspective view illustrating a second upper cover of the image forming apparatus of FIG. 1 in an open position.

FIG. 1 is a schematic perspective view illustrating an image forming apparatus 100 according to an embodiment of the present general inventive concept, and FIG. 2 is a perspective view illustrating a second upper cover of the image forming apparatus 100 of FIG. 1 in an open position.

Referring to FIGS. 1 and 2, the image forming apparatus 100 includes a main frame 101, upper covers 104 and 106, an out-feed tray 102, lower covers 107 and 108, a pressure roller 177, a heat roller 176, a guide claw 109, and rollers 178.

The upper covers 104 and 106 are located in an upper part of the main frame 101 and include a first upper cover 104 and a second upper cover 106. The first upper cover 104 is fixed to the main frame 101. The second upper cover 106 is connected to at least two portions of the first upper cover 104. More specifically, a portion of a first edge of the second upper cover 106 and a portion of a second edge of the second upper cover 106 opposite to the first edge are each pivotably coupled to the first upper cover 104 by a pivoting shaft extending along a third edge of the second upper cover 106. In addition, both corners of a fourth edge of the second upper cover 106 opposite to the pivoting shaft with respect to the first upper cover 104 are coupled to the first upper cover 104, for example, using a hooking technique or other coupling techniques. However, the present general inventive concept is not limited thereto. For example, in embodiments, only a portion of the first edge of the second upper cover 106 and a portion of the second opposite edge of the second upper cover 106 may be rotatably connected to the first upper cover 104, while the fourth edge opposite to the pivoting shaft of the second upper cover 106 may be simply placed on the first upper cover 104 without any portion of the fourth edge being coupled to the first upper cover 104. Furthermore, the first and second edges of the second upper cover 106 can be pivotably coupled to the first upper cover 104 by respective first and second pivoting protrusions instead of the pivoting shaft.

The out-feed tray 102 is located on the upper cover 104.

The pressure roller 177 and the heat roller 176 face each other along an axis direction thereof, and the guide claw 109 contacts an outer circumferential surface of the heat roller 176.

The out-feed tray 102 and the guide claw 109 will be described later.

The rollers 178 are located above the guide claw 109, and perform functions of a decurl unit and an out-feed roller, which will be described later.

The lower covers 107 and 108 to cover the pressure roller 177, the heat roller 176, and the guide claw 109 are located below the upper covers 104 and 106. The lower covers 107 and 108 include a first lower cover 107 and a second lower cover 108. The second lower cover 108 is connected to at least two portions of the first lower cover 107 in a manner such that a portion of a first end of the second lower cover 108 and a portion of a second end of the second lower cover 108 are rotatably connected to the first lower cover 107, and another portion of the first end of the second lower cover 108 and another portion of the second end of the second lower cover 108 are connected to the first lower cover 107 using a hooking technique or other connecting techniques. However, the present general inventive concept is not limited thereto. For example, in embodiments, the lower covers 107 and 108 may be formed as a monolithic unit. In addition, in embodiments, only a portion of the first end of the second lower cover 108 and a portion of the second end of the second lower cover 108 are rotatably connected to the first lower cover 107, and other portions of the first and second ends of the second lower cover 108 may simply be placed on the first lower cover 107, instead of being connected to the first lower cover 107.

Figure 3:
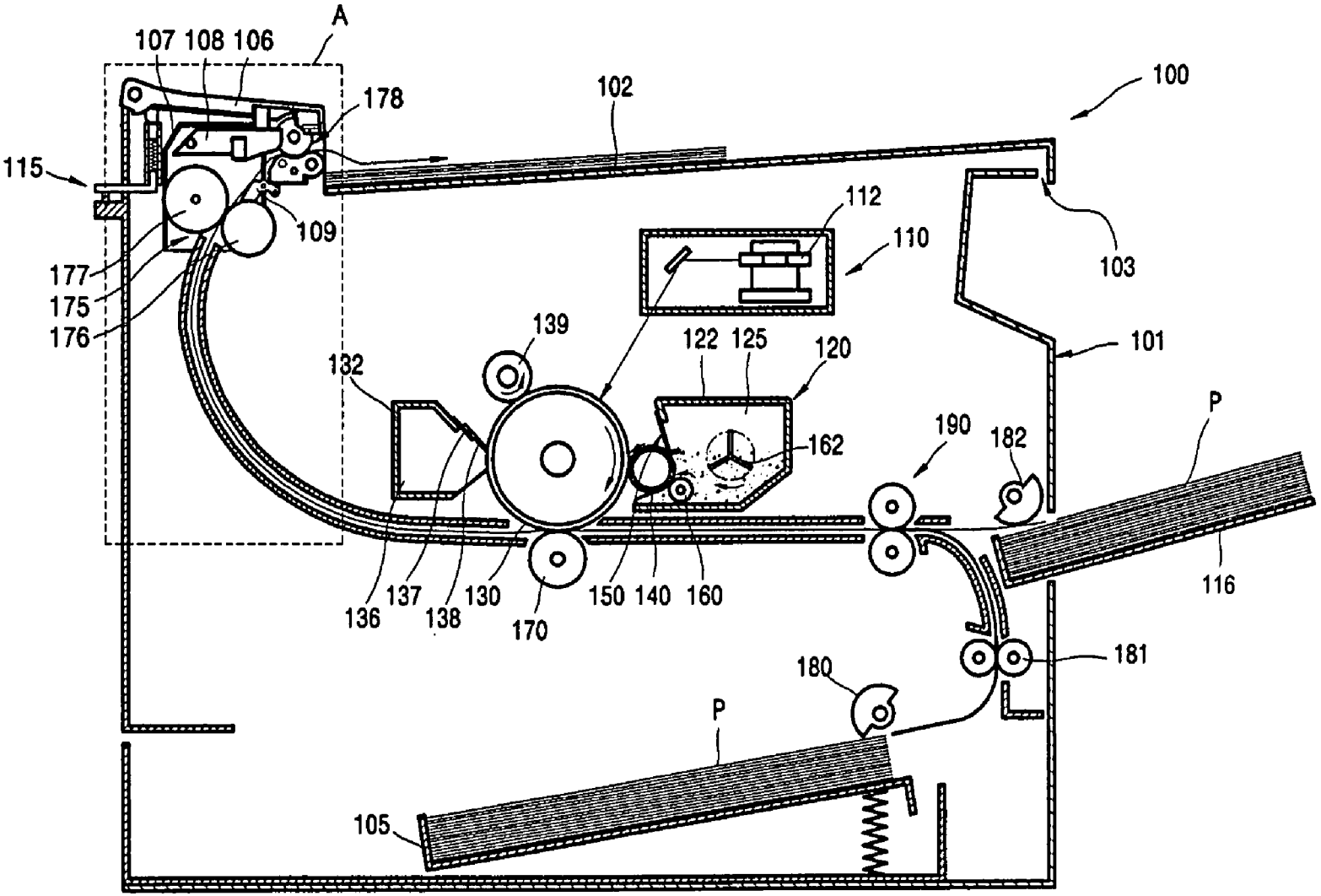
FIG. 3 is a schematic sectional view illustrates the image forming apparatus of FIG. 1, according to an embodiment of the present general inventive concept.

FIG. 3 is a schematic sectional view illustrating the image forming apparatus 100 of FIG. 1, according to an embodiment of the present general inventive concept.

Referring to FIG. 3, the image forming apparatus 100 includes the main frame 101, an exposing unit 110 provided in the main frame 101, a developing unit 120, a photoconductor 130, a cleaning member 138, and a charging roller 139.

The exposing unit 110 irradiates light corresponding to image data onto the photoconductor 130 according to image signals to form an electrostatic latent image on an outer circumferential surface of the photoconductor 130. In addition, the exposing unit 110 includes a light source (not illustrated) that irradiates a laser beam, and a beam deflector that deflects the laser beam irradiated by the light source. The beam deflector may be a polygon mirror 112 that deflects the light while being rotated by a driving source (not illustrated), as illustrated in FIG. 3. On the other hand, the beam deflector may be, for example, a hologram disk (not illustrated) that deflects the light by diffraction due to a hologram pattern formed on a surface of the disk.

The developing unit 120, which can be a cartridge that is detachable from the main frame 101, includes a developing unit housing 122 to form an exterior of the developing unit 120, in which a developing roller 140, a toner layer control unit 150, a supply roller 160, and an agitator 162 are provided. A toner supply unit 125 to store toner as a developing material is provided in the developing unit housing 122. The developing unit 120 can be replaced when the toner stored in the toner supply unit 125 is used up.

A door 103 is provided on an upper part of the main frame 101 so that the developing unit 120 can be put inside of and taken out of the main frame 101.

The developing roller 140 attaches the toner stored in the housing 122 to an outer circumferential surface of the developing roller 140 and supplies the toner to the photoconductor 130. The developing roller 140 stores a solid powder type toner and develops a toner image by supplying the toner to the electrostatic latent image formed on the photoconductor 130. A developing bias voltage is applied to the developing roller 140 to supply the toner to the photoconductor 130. The developing roller 140 can be made by sandblasting an aluminum (Al) core and then applying a nickel (Ni) coating, or by covering a steel special use stainless (SUS) shaft with rubber to a thickness of approximately 1 mm, or by other similar methods. For example, the developing roller 140 may be a non-magnetic conductive rubber roller with a surface roughness (Rz) in a range of approximately 3 to approximately 10 μm in a circumference direction thereof.

A development gap (not illustrated) having a predetermined length is maintained between the photoconductor 130 and the developing roller 140. An electrostatic force directed from the photoconductor 130 to the developing roller 140 is generated by an electric field, and charged toner is transferred to the photoconductor 130 to develop the electrostatic latent image while reciprocally vibrating in a development area formed in the development gap. For example, the development gap may be in a range of approximately 100 to approximately 350 μm, and a minimum gap can be set to be greater than a toner layer thickness.

The supply roller 160 supplies the toner to the developing roller 140, and the toner is attached to the developing roller 140.

The agitator 162 agitates the toner at a predetermined speed to prevent the toner from hardening, and transfers the toner to the supply roller 160.

The toner layer control unit 150 has a first side fixed to the housing 122 and a second side in contact with the developing roller 140, controls a thickness of toner attached on the outer circumferential surface of the developing roller 140, and frictionally charges the toner to a predetermined polarity. The toner layer control unit 150 can be an elastic metal plate. Examples of the metal plate include, but are not limited to, a stainless steel plate, a phosphor bronze plate, and a beryllium copper plate having a thickness of approximately 0.05 to approximately 0.2 mm. For example, the toner layer control unit 150 may be designed such that a constant contact pressure (i.e., a line pressure) in a range of approximately 30 to approximately 40 (gf/cm) acts on the developing roller 140 by using a stainless steel plate with a thickness of approximately 0.08 mm.

The photoconductor 130, in which an outer circumferential surface of a cylindrical metal drum is coated with a photoconductive material layer by deposition or other coating techniques, rotates in a predetermined direction and is positioned such that one portion of its surface is exposed. The photoconductor 130 is electrically charged to a predetermined electric potential by the charging roller 139, and the electrostatic latent image corresponding to a desired image is formed on a surface of the photoconductor 130 by the light irradiated by the exposing unit 110 according to image signals as mentioned above. The exposed portion (not illustrated) of the outer circumference of the photoconductor 130 faces a transfer roller 170.

A charging bias voltage is applied by the charging roller 139 to uniformly charge the outer circumferential surface of the photoconductor 130. Instead of the charging roller 139, a corona discharger (not shown) may be used.

The cleaning member 138 is located in a housing 132 and includes a waste toner storage 136, and one end of the cleaning member 138 contacts the photoconductor 130 with a predetermined pressure to scrape off toner remaining on the photoconductor 130 after transferring of the developed image from the photoconductor 130. An edge portion of a first side of the cleaning member 138 may be disposed at a supporting member 137 additionally located in the housing 138. An edge portion of a second side of the cleaning member 138 contacts the photoconductor 130 with the predetermined pressure to scrape off the toner remaining on the photoconductor 130 after the transferring of the developed image from the photoconductor 130.

The waste toner storage 136 stores the scrapped off toner separated from the photoconductor 130 by the cleaning member 138.

The transfer roller 170 faces the outer circumferential surface of the photoconductor 130, and a transfer bias voltage of opposite polarity to the toner image is applied thereto so that the toner image developed on the photoconductor 130 is transferred onto a printing medium P. The toner image is transferred onto the printing medium P by the electrostatic force acting between the photoconductor 130 and the developing roller 140. Here, the toner image developed on the outer circumferential surface of the photoconductor 130 may be transferred onto the printing medium P passing between the transfer roller 170 and the photoconductor 130 by contact pressure between the photoconductor 130 and the transfer roller 170.

A fixing unit 175, which includes the heat roller 176 and the pressure roller 177 facing the heat roller 176, fuses the toner image onto the printing medium P by applying heat and pressure to the toner image transferred onto the printing medium P. The heat roller 176 is a heat source to permanently fix the toner image and extends along an axis direction of the pressure roller 177. The pressure roller 177 faces the heat roller 176 and fuses the toner image onto the printing medium P by applying high pressure to the printing medium P.

A decurl unit 178 removes curls of the printing medium P which are generated due to the heat when the printing medium P passes the fixing unit 175. An out-feed roller 178 feeds the printing medium P out of the image forming apparatus 100 after fusing. The printing medium P fed out of the image forming apparatus 100 is loaded into the out-feed tray 102. In this embodiment, the out-feed roller 178 also carries out the function of the decurl unit 178. Namely, the decurl unit 178 and the out-feed roller 178 may be combined as a single unit. However, in other embodiments, the decurl unit 178 and the out-feed roller 178 can be separate units.

The image forming apparatus 100 includes first and second feeding cassettes 105 and 116 which are provided in a lower part of the main frame 101 and on which the printing medium P is loaded. In embodiments, the image forming apparatus 100 may include only one of the first paper feeding cassette 105 and the second paper feeding cassette 116.

Pick-up units 180 and 182 pick up the loaded printing medium P sheet by sheet and feed out the printing medium P from the first and second feeding cassettes 105 and 116, respectively.

A feed roller 181 provides a feed force to feed the picked up printing medium P towards a paper arranging unit 190. The paper arranging unit 190 arranges the printing medium P so that the toner image can be transferred onto a desired portion of the printing medium P before the printing medium P passes between the photoconductor 130 and the transfer roller 170.

Hereinafter, an operation of the image forming apparatus 100 of FIG. 3, according to an embodiment of the present general inventive concept, will be described.

The photoconductor 130 is equipotentially charged by a changing bias voltage applied by the charging roller 139. The exposing unit 110 irradiates light corresponding to image data onto the photoconductor 130. The charge on a portion of the photoconductor 130 where the light is irradiated is selectively removed, decreasing an electric potential of that portion. An electrostatic latent image is an output pattern formed by this electric potential difference.

Toner in the toner supply unit 125 is agitated by the agitator 162 and supplied to the developing roller 140 to which a developing bias voltage is applied by the supply roller 114.

The toner attached on an outer circumferential surface of the developing roller 140 is thinned to a uniform thickness by the toner layer control unit 150. At this time, the toner is frictionally charged by the developing roller 140 and the toner layer control unit 150.

The toner attached on the outer circumferential surface of the developing roller 140 is attached on the electrostatic latent image formed on an outer circumferential surface of the photoconductor 130, and a toner image is thereby developed onto the photoconductor 130.

The printing medium P is fed out of the paper feeding cassette 105 by the pick-up unit 180. Next, the printing medium P is fed by the feed roller 181, loaded and arranged by the paper arranging unit 190, and passed between the photoconductor 130 and the transfer roller 170. At this time, if a transfer bias voltage is applied to the transfer roller 170, the toner image is transferred from the photoconductor 130 onto the printing medium P.

The toner remaining on the outer circumferential surface of the photoconductor 130 after transferring is removed by the cleaning member 138 and accumulated in the waste toner storage 136.

The fixing unit 175 fuses the toner image onto the printing medium P by applying heat and pressure to the toner image formed on the printing medium P after transferring.

The decurl unit 178 removes curls in the printing medium P generated when the printing medium P passes through the fixing unit 175.

The printing medium P passes the decurl unit 178 is then fed out of the image forming apparatus 100 and loaded onto the out-feed tray 102. In this embodiment, the decurl unit 178 and the out-feed roller 178 are combined as a single unit, although in other embodiments the decurl unit 178 and the out-feed roller 178 can be separate units.

Figure 4A:
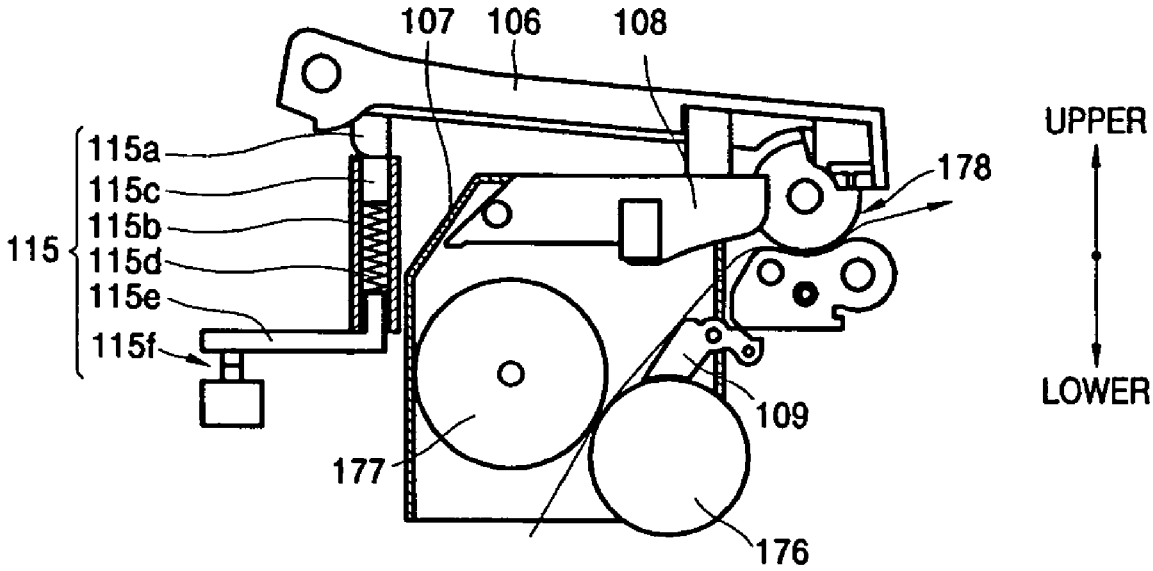
FIG. 4A is an enlarged schematic sectional view illustrating a portion A of the image forming apparatus of FIG. 3 during normal printing operations, according to an embodiment of the present general inventive concept.
Figure 4B:
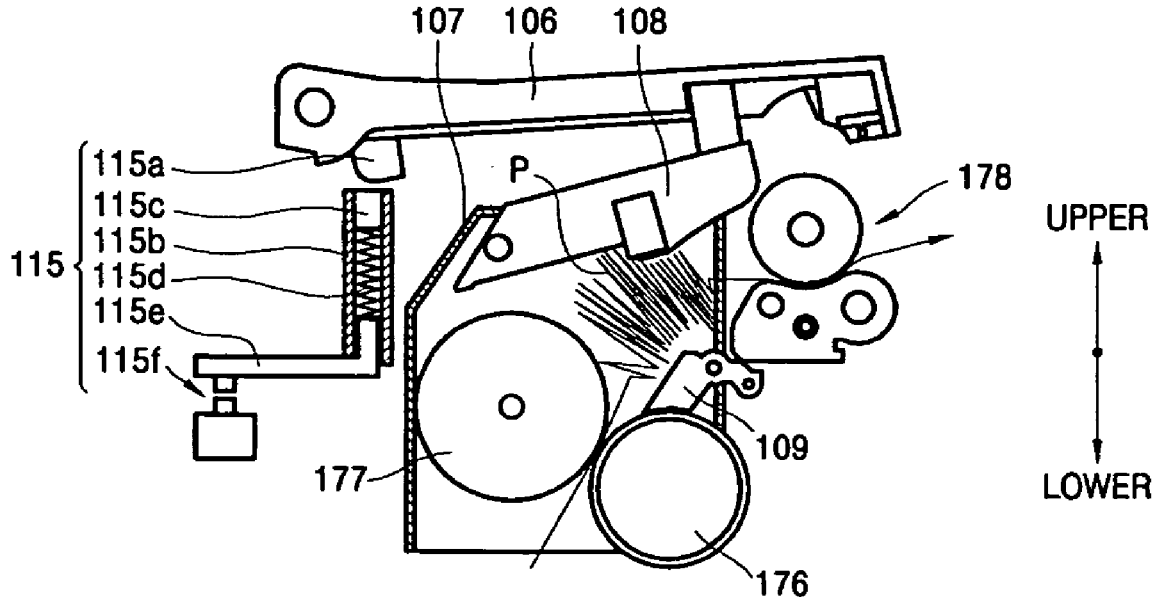
FIG. 4B is an enlarged schematic sectional view illustrating a portion A of the image forming apparatus of FIG. 3 during a printing medium jam, according to an embodiment of the present general inventive concept.
Figure 5:
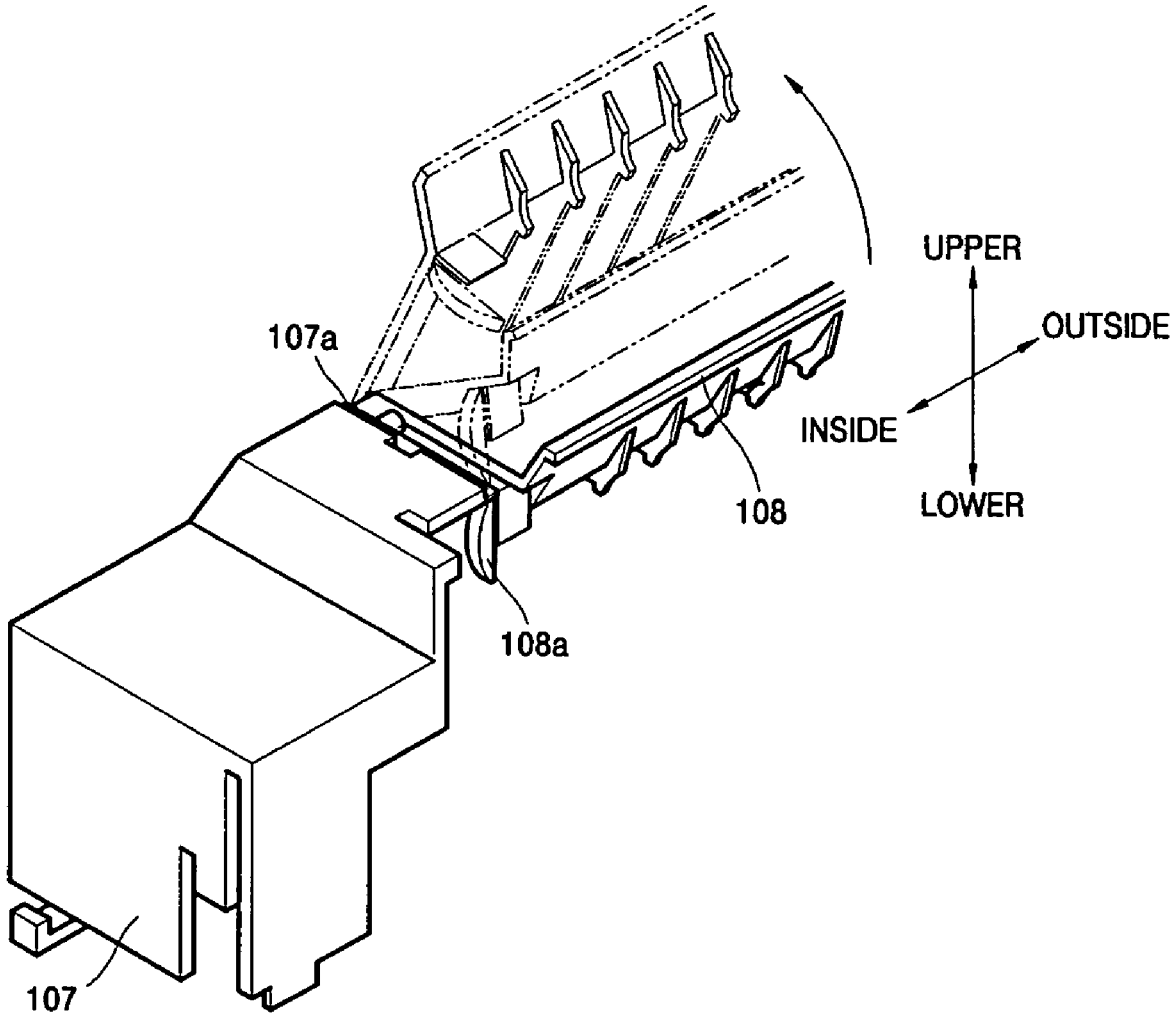
FIG. 5 is a partial perspective view illustrating stages where a second lower cover is separated from a first lower cover after a connection with a first lower cover is released by a pressure of a printing medium caused by a printing medium jam, according to an embodiment of the present general inventive concept.
Figure 6A:
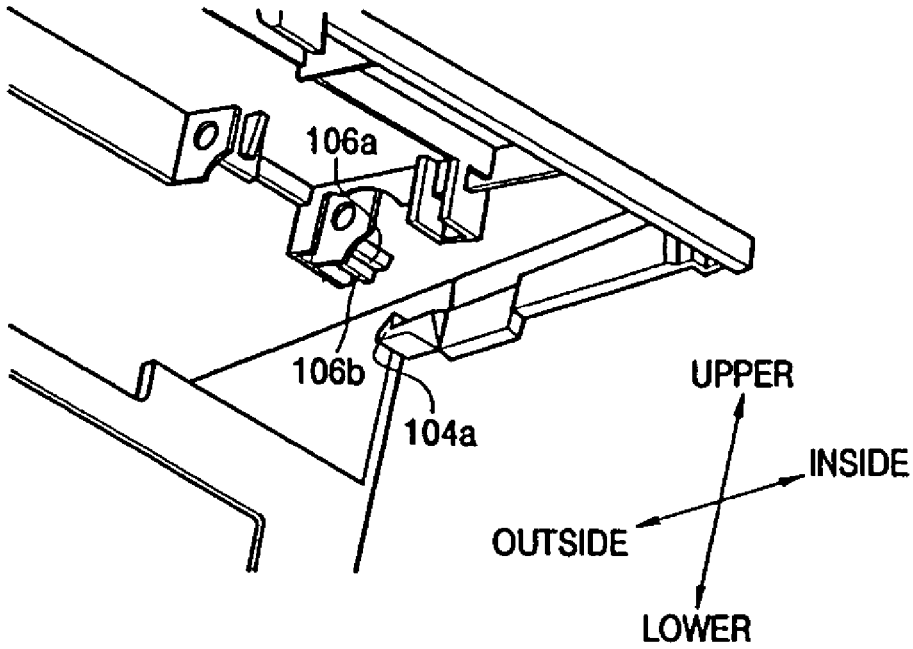
FIGS. 6A and 6B are partial perspective views illustrating stages where a second upper cover is separated from a first upper cover after a connection with a first upper cover is released by a pressure of a printing medium caused by a printing medium jam, according to an embodiment of the present general inventive concept.
Figure 6B:
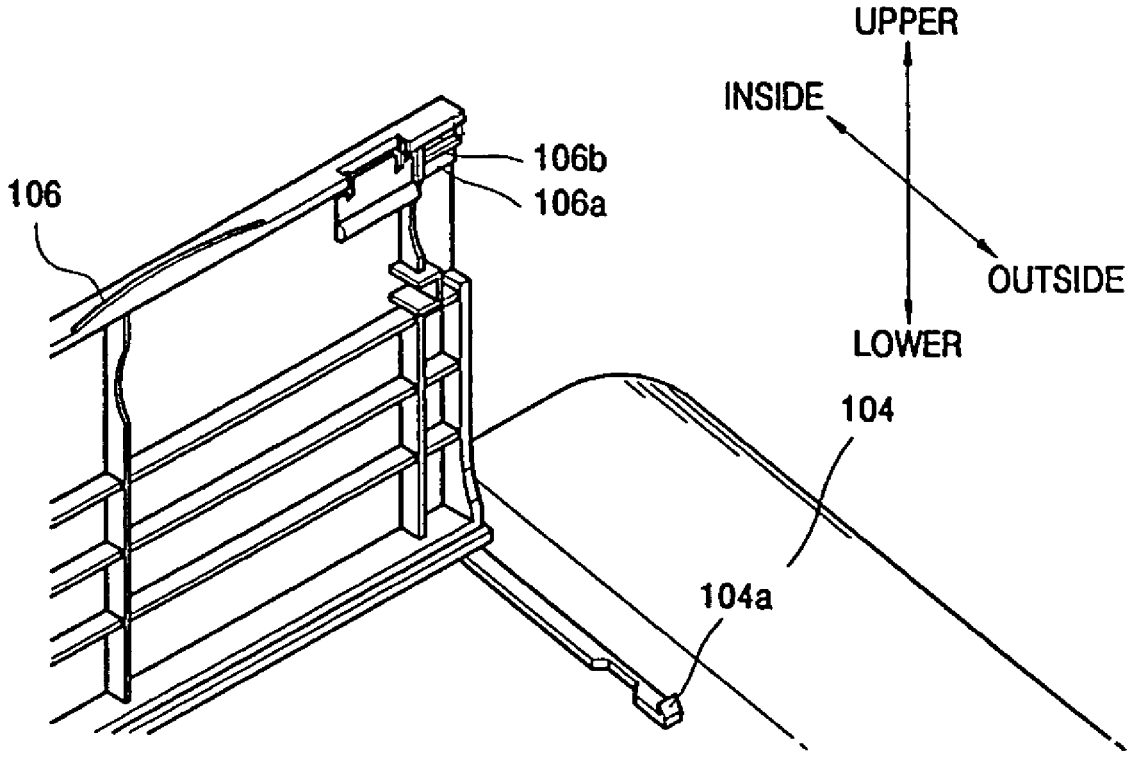

FIG. 4A is an enlarged schematic sectional view illustrating a portion A of the image forming apparatus 100 of FIG. 3 during normal printing operations, according to an embodiment of the present general inventive concept. FIG. 4B is an enlarged schematic sectional view illustrating a portion A of the image forming apparatus 100 of FIG. 3 during a printing medium jam, according to an embodiment of the present general inventive concept. FIG. 5 is a partial perspective view illustrating stages where a second lower cover is separated from a first lower cover after a connection with a first lower cover is released by a pressure of a printing medium caused by a printing medium jam, according to an embodiment of the present general inventive concept. FIGS. 6A and 6B are partial perspective views illustrating stages where a second upper cover is separated from a first upper cover after a connection with a first upper cover is released by a pressure of a printing medium caused by a printing medium jam, according to an embodiment of the present general inventive concept.

First, a configuration of elements of FIG. 4A will be described.

The pressure roller 177 and the heat roller 176 face each other along an axis direction thereof, and the guide claw 109 contacts an outer circumferential surface of the heat roller 176.

The rollers 178 are located above the guide claw 109, and the second lower cover 108 is located at a same or a similar height as the rollers 178. The second lower cover 108 is rotatably connected to the first lower cover 107, and the first lower cover 107 covers all of the pressure roller 177 and most of the heat roller 175 and the second lower cover 108 from the side sectional view as illustrated in FIG. 4A. Here, the second lower cover 108 is closed during the normal printing operation.

The second upper cover 106 is located above the second lower cover 108. The first upper cover 104 (see FIGS. 1 and 2) is not illustrated in FIG. 4A for convenience. Here, the second upper cover 106 is closed during the normal printing operation.

A printing medium jam detection unit 115 operated by the second upper cover 106 is located below the second upper cover 106. The printing medium jam detection unit 115 may include a pressure portion 115*a*, a base 115*b*, a plunger 115*c*, a spring 115*d*, an operation lever 115*e*, and a switch 115*f*. However, the present general inventive concept is not limited thereto.

The pressure portion 115*a* protrudes from a lower surface of the second upper cover 106 substantially perpendicular to a flat surface of the second upper cover 106, and may have an I shape. However, the present general inventive concept is not limited thereto, and the pressure portion 115*a* may be formed in various shapes, such as an L shape.

The base 115*b* is located in the main frame 101 (see FIGS. 1-3) and includes the plunger 115*c*, the spring 115*d*, and the operation lever 115*e*.

The plunger 115*c* is located in the base 115*b* at a position facing the pressure portion 115*a*, and transfers pressure from the pressure portion 115*a* to the spring 115*d*.

The spring 115*d* transfers the pressure from the plunger 115*c* to the operation lever 115*e*.

The operation lever 115*e* transfers the pressure from the spring 115*d* to the switch portion 115*f*.

The switch portion 115*f* is located in the main frame 101 (see FIGS. 1-3) at a position facing the operation lever 115*e*, and performs opening and closing operations.

The printing medium P, as illustrated in FIG. 4A, passes through a nip of the fixing unit 175 (see FIG. 3) between the pressure roller 177 and the heat roller 176, and is then separated from the heat roller 176 by the guide claw 109, and fed out through the out-feed roller 178.

The present general inventive concept is not limited to this embodiment illustrated in FIG. 4A, and various changes in form and detail may be made therein without departing from the spirit and scope of the present general inventive concept.

Next, a configuration of elements of FIG. 4B will be described.

FIG. 4B illustrates an operation of the elements to stop printing when a printing medium jam, such as an accordion effect, takes place on a feed path. The accordion effect refers to when the printing medium P is crumpled and folded like an accordion when the printing medium P is jammed in the image forming apparatus 100, and usually takes place in a space between the fixing unit 175 (see FIG. 3), which includes the heat roller 176 and the pressure roller 177, and the second lower cover 108.

Once a predetermined printing medium P is jammed, other sheets of printing medium P fed thereafter along the feed path are also jammed in series. Therefore, when a plurality of sheets of printing medium P are not fed out but are instead entangled and accumulated in the printing medium jam, the printing medium P pushes the guide claw 109 located around the heat roller 176, the guide claw 109 then presses the heat roller 176, causing damage (such as a scratch) to the heat roller 176. In addition, if the plurality of sheets of printing medium P are jammed in series, the sheets P are strongly entangled with each other. Therefore, this causes damage to the heat roller 176, and the printing medium P is not easily removed from the image forming apparatus 100.

Accordingly, the present general inventive concept provides an image forming apparatus that can sense printing medium jams without an expensive out-feed sensor included in a conventional image forming apparatus, and more efficiently than in a case with the out-feed sensor, by improving structures of lower and upper covers of the image forming apparatus and by providing a printing medium jam detection unit operated by the upper cover.

Hereinafter, an operation of the printing medium jam detection unit 115 of FIGS. 3-4B, according to an embodiment of the present general inventive concept, will be described in detail.

When the printing medium P is jammed in a space between the fixing unit 175 (see FIG. 3), which includes the heat roller 176 and the pressure roller 177, and the rollers 178, as shown in FIG. 4B, a connection (e.g., a hook) between the first lower cover 107 and the second lower cover 108 is released and one end of the second lower cover 108 opens upwards. Referring to FIG. 5, this process will be described in more detail.

A holder 107*a* is formed on each end of the first lower cover 107, and a hook 108*a* is formed on each end of the second lower cover 108 facing the holder 107*a*.

When the second lower cover 108 is closed, the hook 108*a* of the second lower cover 108 is located below the holder 107*a* of the first lower cover. Since the hook 108*a* inwardly protrudes from the holder 107*a* along a vertical line connecting an upper side of the image forming apparatus to a lower side thereof, the second lower cover 108 does not open when a pressure pushing the second lower cover 108 upwards is less than a predetermined reference value. However, when the printing medium is jammed, a pressure that pushes the second lower cover 108 upwards becomes greater than the predetermined reference value, so the hook 108*a* goes around the holder 107*a* and is raised over the holder 107*a*, as illustrated in FIG. 5, and the second lower cover 108 is opened. Here, the predetermined reference value can be a pressure that does not damage the heat roller 176 when the guide claw 109 presses the heat roller 176. In addition, if a pressure becomes greater than the reference value, a thickness t of the hook 108*a* must be determined properly in order to allow the second lower cover 108 to open upwards. As the thickness t of the hook 108*a* increases, more of the hook 108*a* is held in the holder 107*a*, so the second lower cover 108 is more difficult to open. Conversely, as the thickness t of the hook 108*a* decreases, less of the hook 108*a* is held in the holder 107*a*, so the second lower cover 108 is more easily opened. In addition, an extent of the holding of the hook 108*a* is related not only to the thickness t of the hook 108*a* but also a width and a material of the hook 108*a* and a thickness and a material of the holder 107*a*, so these values must be taken into account when the image forming apparatus is designed.

When the second lower cover 108 is open, as illustrated in FIG. 4B, one portion of the second lower cover 108 contacts the second upper cover 106, pushing the second upper cover 106 upwards. This process will be described in more detail with reference to FIGS. 6A and 6B.

A holder 104*a* in a shape of a protrusion is formed at a portion of the first upper cover 104 that contacts the second upper cover 106, and a hook 106*a* is formed at a portion of the second upper cover 106 that faces the holder 104*a*. Namely, a portion of a first edge of the second upper cover 106 and a portion of a second opposite edge thereof are pivotably coupled to the first upper cover 104, and hooks 106*a* are formed at corners of the first and second edges opposite to the portions pivotably coupled to the first upper cover 104 (e.g., opposite to a pivoting shaft of the second upper cover 106). Here, if a flat plate disposed parallel to a flat surface of the second upper cover 106 is divided into two portions by a reinforcement member 106*b*, the hook 106*a* is on one of the two portions, such as a portion of the second upper cover 106 located relatively far from a corner of the second upper cover 106 having the portion pivotably coupled to the first upper cover 104. However, the present general inventive concept is not limited to this, and the hook 106*a* may be located at various other positions and may take various forms.

When the second upper cover 106 is closed, the hook 106*a* of the second upper cover 106 is located below the holder 104*a* of the first upper cover 104. Since the hook 106*a* inwardly protrudes from the holder 104*a* along a line perpendicular to a vertical line connecting an upper side of the image forming apparatus to a lower side thereof (see. FIGS. 6A and 6B), the second upper cover 106 does not open when a pressure pushing the second upper cover 106 upwards is less than a predetermined reference value. However, if the second upper cover 106 is open when the printing medium is jammed, and a pressure applied from the second lower cover 108 to the second upper cover 106 is greater than the predetermined reference value, then the hook 106*a* goes around the holder 104*a* and is raised over the holder 104*a*, and the second upper cover 106 is opened. The predetermined reference value can be a pressure that does not damage the heat roller 176 when the guide claw 109 presses the heat roller 176. In addition, if a pressure becomes greater than the reference value, a length l of the hook 106*a* must be determined properly in order to allow the second upper cover 106 to open upwards. As the length l of the hook 106*a* increases, more of the hook 106*a* is held in the holder 104*a*, so the second upper cover 106 is not easily opened. Conversely, as the length l of the hook 106*a* decreases, less of the hook 106*a* is held therein, so the second lower cover 106 is more easily opened. In addition, an extent of the holding of the hook 106*a* is related not only the length l of the hook 106*a* but also a thickness thereof, a width and a material of the hook 106*a*, and a thickness, a width, and a material of the holder 104*a*, so these values must be taken into account when the image forming apparatus is designed.

Figure 7:
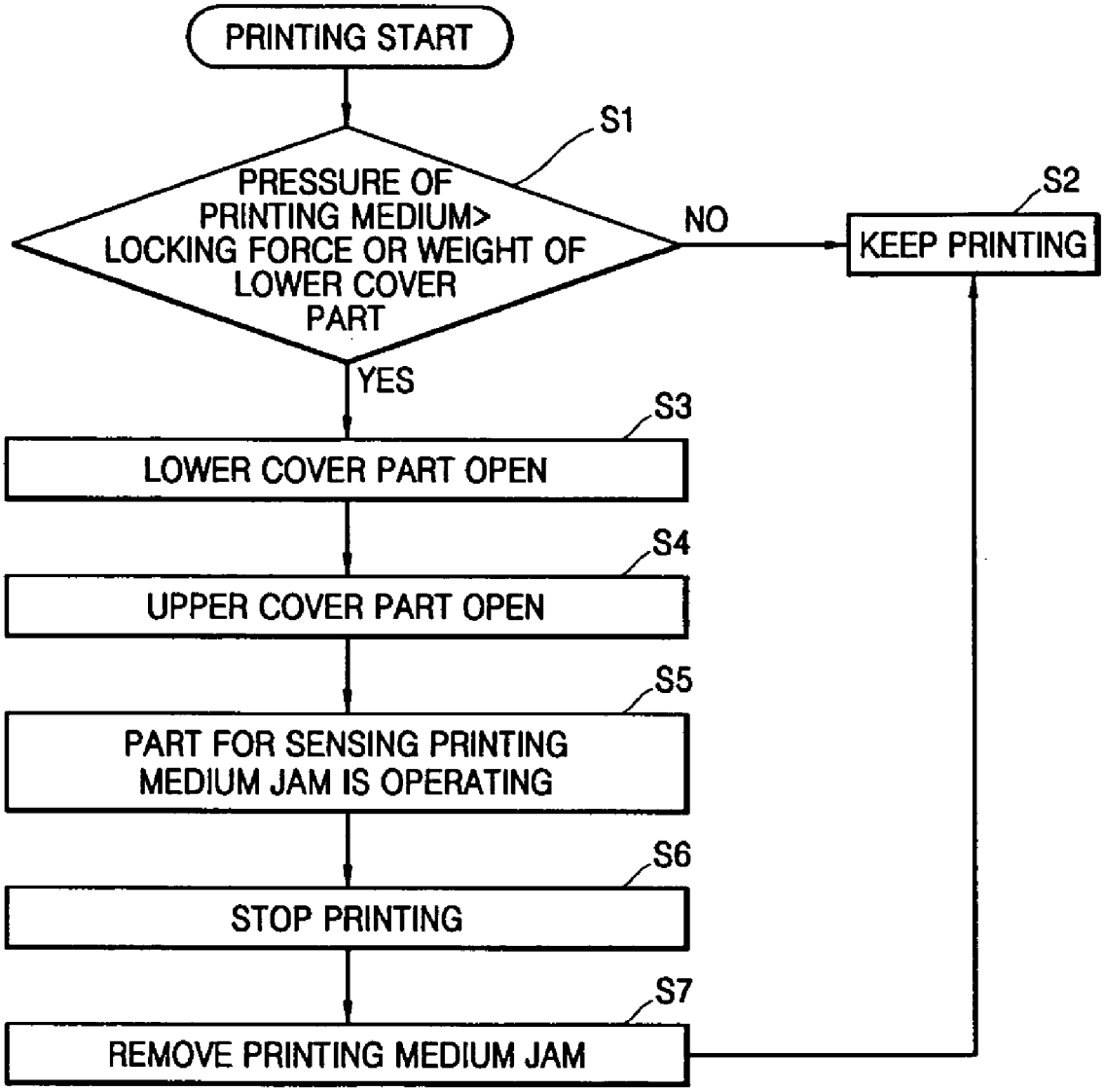
FIG. 7 is a flowchart illustrating a method of sensing a printing medium jam in an image forming apparatus, according to the embodiment of the present general inventive concept.

FIG. 7 is a flowchart illustrating a method of sensing a printing medium jam in an image forming apparatus, according to an embodiment of the present general inventive concept.

Unlike a conventional method of using an out-feed sensor, a method of sensing a printing medium jam in the image forming apparatus according to this embodiment of the present general inventive concept uses only an opening and a closing of covers without the out-feed sensor. In this method, the printing medium jam can be simply sensed by associating a switch that applies two electric signals, in which one is for continuing printing and the other is for stopping printing, with an opening/closing of the cover.

Since it is inexpensive to change a structure of an image forming apparatus to the aforementioned structure, a same or a superior sensing capability can be achieved with less cost by using the sensing method of this embodiment as compared with the conventional method.

Hereinafter, the method of sensing a printing medium jam in the image forming apparatus according to this embodiment of the present general inventive concept will be described step by step with reference to FIG. 7. The image forming apparatus includes covers and a printing medium jam detection unit, and the covers include a lower cover and an upper cover.

First, the lower cover is closed at a beginning of printing. During the printing, the lower cover is opened or closed according to a relationship between a pressure of the printing medium on the lower cover and a locking force or weight of the lower cover (operation S1).

When the pressure of the printing medium on the lower cover is less than the locking force or weight of the lower cover (that is, when the printing medium is not jammed), the lower cover remains closed, and printing continues (operation S2). Here, the opening or closing of the lower cover according to the locking force of the lower cover means the opening or closing of the lower cover based on whether the lower cover is locked into or unlocked from another component of the image forming apparatus according to a difference between the locking force and the pressure with which the locked lower cover is pushed by the printing medium. In addition, the opening or closing of the lower cover according to the weight of the lower cover means the opening or closing of the lower cover according to a difference between the pressure with which a lower cover that is not coupled to another component of the image forming apparatus is pushed by the printing medium and the weight of the lower cover.

Next, if the pressure of the printing medium is greater than the locking force of the lower cover or the weight thereof (that is, the printing medium is jammed), the lower cover is opened (operation S3).

When the lower cover is open, the upper cover is pushed up by the lower cover and thus the upper cover is opened (operation S4).

When the upper cover is open, a printing medium jam detecting unit connected to the upper cover operates (operation S5), and printing stops (operations S6).

Then, the jammed printing medium can be removed from the image forming apparatus manually or with an additional mechanism (operation S7), and printing can begin again (operation S2).

In the method of this embodiment, the printing medium pushes the lower cover, and the lower cover then pushes the upper cover, but the present general inventive concept is not limited thereto, and the lower cover may be combined with the upper cover, and the printing medium may push the combined cover. In addition, although in this embodiment the cover portion includes two covers (the lower cover and the upper cover), the cover portions may include more than three covers, and in this case, a plurality of covers can open in series from the lower side to the upper side.

The present general inventive concept provides an image forming apparatus having a lower production cost and a method of sensing a printing medium jam in the image forming apparatus.

Accordingly, in an image forming apparatus according to embodiments of the present general inventive concept, a serious printing medium jam can be prevented, so that a guide claw, which separates a printing medium passing a fuser nip from a heat roller, is prevented from being pressed by the printing medium and damaging the heat roller when the printing medium is jammed.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus to form an image on a printing medium, the image forming apparatus comprising:

a lower cover disposed to be contacted by the printing medium when the printing medium is jammed on a feed path and which opens upwards when a pressure of the printing medium caused by the printing medium jam is greater than a predetermined reference value;

an upper cover disposed to be opened by being contacted by the lower cover when the lower cover opens; and a printing medium jam detection unit to be operated by the upper cover.

2. The image forming apparatus according to claim 1, further comprising:

a fixing unit located at a lower side of the lower cover and including a heat roller and a pressure roller to fuse a toner image onto the printing medium by applying heat and pressure to the toner image transferred onto the printing medium.

3. The image forming apparatus according to claim 2, further comprising:

a guide claw to contact the heat roller and separate the printing medium fed out of the fixing unit from the heat roller.

4. The image forming apparatus according to claim 1, wherein the lower cover comprises:

a first lower cover fixed to a main frame of the image forming apparatus; and a second lower cover to open upwards when the pressure of the printing medium caused by the printing medium jam is greater than the predetermined reference value.

5. The image forming apparatus according to claim 4, wherein the second lower cover comprises at least two portions connected with the first lower cover, wherein at least one portion of the second lower cover is rotatably connected with the first lower cover and at least another portion of the second lower cover is connected with the first lower cover by a hook, and the connection by the hook is released when the pressure of the printing medium caused by the printing medium jam is greater than the predetermined reference value.

6. The image forming apparatus according to claim 1, wherein the upper cover comprises:

a first upper cover fixed to a main frame of the image forming apparatus; and a second upper cover disposed to be opened by being contacted by the lower cover when the lower cover opens.

7. The image forming apparatus according to claim 6, wherein the second upper cover comprises at least two portions connected with the first upper cover, at least one portion of the second upper cover is rotatably connected with the first upper cover and at least another portion of the second upper cover is connected with the first upper cover by a hook, and the connection by the hook is released by pressure from the lower cover when the lower cover opens.

8. The image forming apparatus according to claim 1, wherein the printing medium jam detection unit comprises:

a pressure portion formed in the upper cover;

a base located in a main frame of the image forming apparatus;

a plunger located in the base at a position facing the pressure portion;

a spring in contact with the plunger;

an operation lever connected to the spring; and a switch located in the main frame at a position facing the operation lever to perform opening and closing operations.

9. The image forming apparatus according to claim 8, wherein when the upper cover is closed, the pressure portion pushes the plunger down, the plunger then pushes the spring, the spring then pushes the operation lever, and the operation lever then operates the switch.

10. The image forming apparatus according to claim 8, wherein when the upper cover is open, the pressure portion is separated from the plunger, the spring connected to the plunger is released from the operation lever, and the operation lever releases the switch.

11. The image forming apparatus according to claim 8, wherein the pressure portion has an I shape, and the operation lever has an L shape.

12. A detection system usable in an image forming apparatus to detect a printing medium jam, the system comprising:

a frame;

at least one cover unit to be opened by a pressure applied thereto by a printing medium when the pressure of the printing medium due to a printing medium jam is greater than a predetermined threshold pressure; and a detection unit to detect the printing medium jam when the at least one cover unit is in an open position, wherein:

the at least one cover unit comprises:

a lower cover unit to be opened by a pressure applied thereto by the printing medium when the pressure of the printing medium is greater than the predetermined threshold pressure; and an upper cover unit to receive a pressure from the lower cover unit when opened and to be opened by the lower cover unit pressure, wherein the detection unit is in contact with the upper cover unit to detect the printing medium jam when the upper cover unit opens.

13. The detection system according to claim 12, wherein at least one of a weight of the upper cover unit, a weight of the lower cover unit, and a connection of the lower and upper cover units prevents the upper cover unit from opening until the pressure is greater than the predetermined threshold pressure.

14. The detecting system according to claim 12, further comprising:

a fixing unit to apply heat and pressure to a printing medium to fix an image thereon as the printing medium passes through the fixing unit along a feed path.

15. The detecting system according to claim 14, where the detecting unit is positioned a predetermined distance apart from the feed path.

16. The detecting system according to claim 14, wherein the lower cover unit covers at least a portion of the fixing unit.

17. The detecting system according to claim 12, wherein the detecting unit comprises:

an elastic member to elastically-bias the upper cover unit to be in a closed position; and signal generating part to generate a signal to stop a printing operation when the upper cover unit is in the open position.

18. The detecting system according to claim 12, wherein the detecting unit is electrically-connected to the upper cover unit.

19. The detecting system according to claim 18, wherein the detecting unit generates a first signal to continue a printing operation and a second signal to stop a printing operation based on whether the upper cover unit is in a closed position or in the open position.

20. The detecting system according to claim 12, wherein the pressure received from the lower cover unit by the upper cover unit breaks a connection between the lower and upper cover units.

21. The detecting system according to claim 12, wherein the upper cover unit comprises:

a fixed part fixed to the frame; and a moveable part moveable in response to the pressure received from the lower cover unit.

22. The detecting system according to claim 12, wherein the lower cover unit comprises:

a fixed part fixed to the frame; and a moveable part moveable in response to the pressure applied by the printing medium blockage when the pressure is greater than the predetermined threshold pressure.

23. A method of detecting a printing medium jam in an image forming apparatus, the method comprising:

causing a lower cover unit to open using a pressure applied thereto from by a printing medium when the pressure of the printing medium due to a printing medium jam is greater than a threshold value;

causing an upper cover unit to open using a pressure from the lower cover unit when the lower cover unit opens; and detecting the printing medium jam when the upper cover unit opens.

* * * * *